United States Patent [19]

Roe et al.

[11] 4,073,336

[45] Feb. 14, 1978

[54] CENTRIFUGAL CASTING MACHINE

[76] Inventors: Edward A. Roe, R.R. No. 6, Box 26, Omaha, Nebr. 68112; Harold F. Schulte, 3009 Cass St., Omaha, Nebr. 68131

[21] Appl. No.: 510,372

[22] Filed: Sept. 30, 1974

[51] Int. Cl.[2] ..... B22D 13/04

[52] U.S. Cl. ..... 164/286; 164/259; 164/337

[58] Field of Search ..... 164/259, 286, 298, 116, 164/114; 425/425, 429, 435

[56] References Cited

U.S. PATENT DOCUMENTS

| | | | |
|---|---|---|---|
| 18,924 | 12/1857 | Needham | 164/116 X |
| 1,501,338 | 7/1924 | Henry | 164/116 |
| 1,620,830 | 3/1927 | Moore et al. | 164/115 |
| 1,882,516 | 10/1932 | Naugle et al. | 164/114 |
| 3,040,398 | 6/1962 | Warkoczewski | 164/114 X |

FOREIGN PATENT DOCUMENTS

| | | | |
|---|---|---|---|
| 73,021 | 9/1951 | Denmark | 164/286 |
| 546,340 | 2/1932 | Germany | 164/286 |
| 814,498 | 9/1951 | Germany | 164/286 |
| 363,142 | 12/1931 | United Kingdom | 164/286 |
| 723,809 | 2/1955 | United Kingdom | 164/114 |

OTHER PUBLICATIONS

"Centrifuged Tubular Bodies and Processes and Apparatuses for their Manufacture," J. Boucher, Alien Property Custodian.

*Primary Examiner*—Robert D. Baldwin
*Attorney, Agent, or Firm*—Zarley, McKee, Thomte, Voorhees & Sease

[57] ABSTRACT

A centrifugal casting machine comprising a support means having a housing pivotally mounted thereon about a horizontal axis to permit the housing to be tilted relative to the support means. A mold member is rotatably mounted within the housing and has a drive shaft connected thereto extending through the rearward side of the housing for connection to a power means such as an electric motor. The power shaft is provided with a bore extending therethrough to permit argon gas or the like to be furnished to the interior of the mold member to reduce the oxidation or the like to be furnished to the interior of the mold member to reduce the oxidation of the aluminum casting material. The casting material support stand is positioned forwardly of the housing and has a casting material hopper selectively vertically mounted thereon for supplying the casting material to the interior of the housing and mold member.

5 Claims, 12 Drawing Figures

CENTRIFUGAL CASTING MACHINE

BACKGROUND OF THE INVENTION

This invention relates to a centrifugal casting machine and more particularly to a centrifugal casting machine wherein the rotatable mold may be selectively inclined relative to a horizontal plane.

Conventional centrifugal casting machines generally comprise a rotatable mold member which is rotatable about a vertical axis. The fact that the rotatable mold is rotatable about a vertical axis requires that the molten casting material be furnished to the interior of the mold member from a position above the apparatus. Additionally, the conventional centrifugal casting machines due to the construction thereof are less than desirable since the casting material sometimes undesirably "roils" thereby resulting in a less than perfect finished product. A problem encountered with the casting of aluminum in a centrifugal casting machine is that the aluminum tends to oxidise during the casting and cooling periods since the casting material is exposed to the atmosphere during the casting and cooling operations.

Therefore, it is a principal object of the invention to provide a centrifugal casting machine wherein the mold member may be selectively tilted to permit the casting material to be introduced into the interior of the mold member from the forward portion thereof.

A further object of the invention is to provide a centrifugal casting machine including means for introducing a gas to the interior thereof.

A further object of the invention is to provide a centrifugal casting machine including means for introducing argon gas into the interior of the mold to prevent the oxidation of the aluminum casting material.

A further object of the invention is to provide a centrifugal casting machine including means for introducing the molten casting material to the forward portion of the apparatus.

A still further object of the invention is to provide a centrifugal casting machine which is durable.

These and other objects will be apparent to those skilled in the art.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings, in which:

DESCRIPTION OF THE PREFERRED EMBODIMENT

Figure 1:
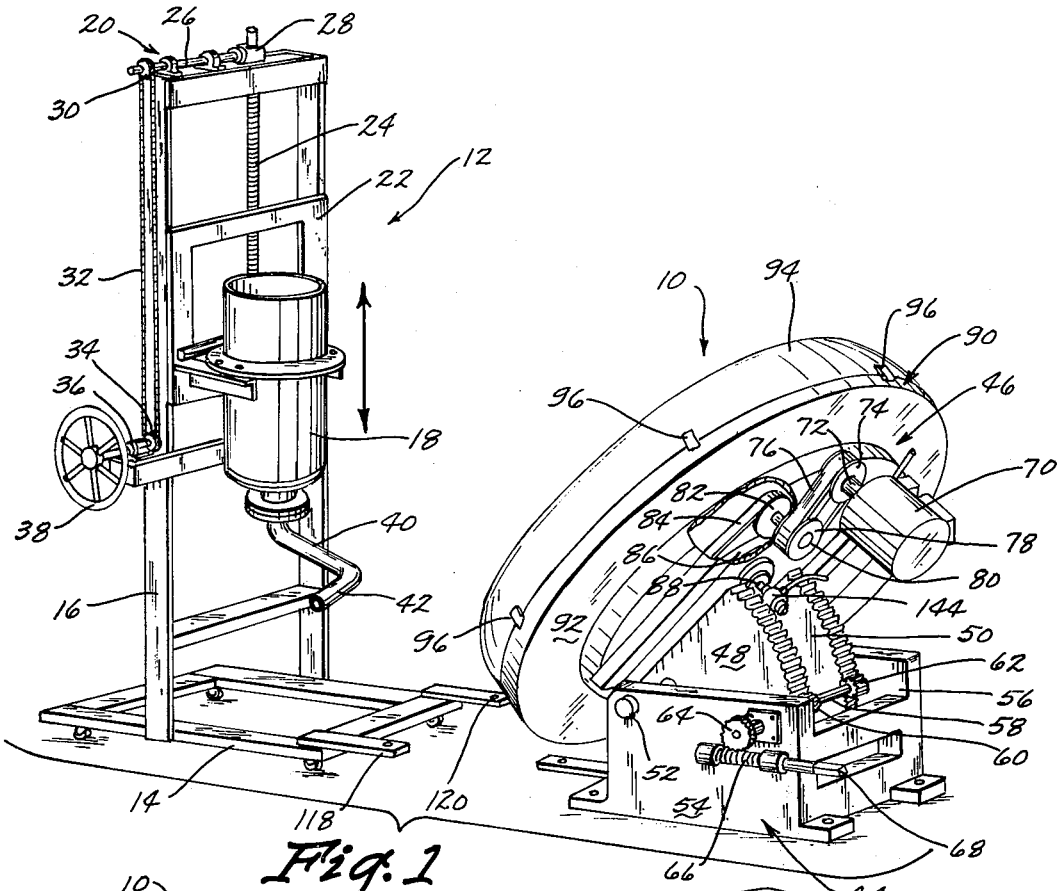
FIG. 1 is a rear perspective view of the centrifugal casting machine and the apparatus for introducing the casting material therein.
Figure 2:
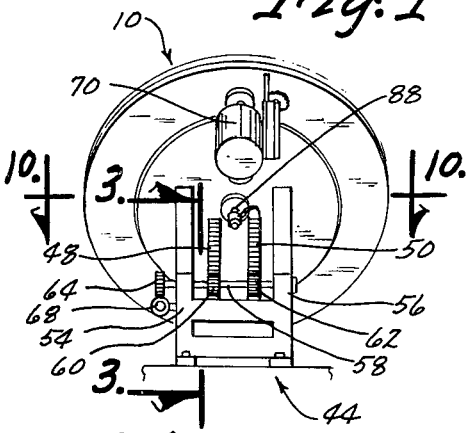
FIG. 2 is a rear view of the casting machine.
Figure 3:
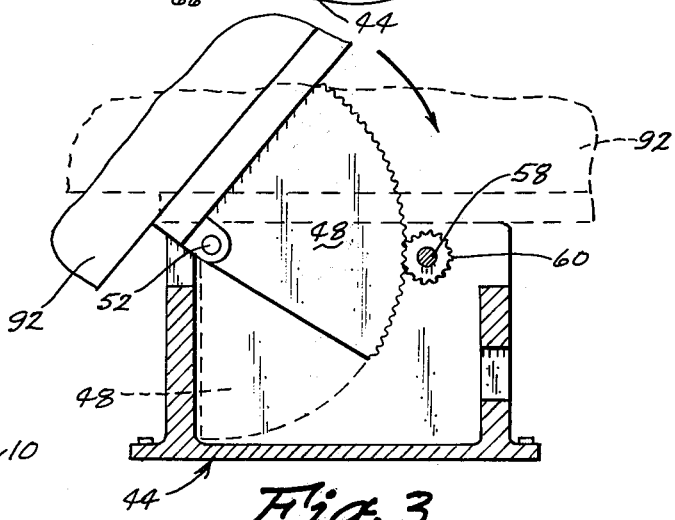
FIG. 3 is a partial sectional view as seen on lines 3 — 3 of FIG. 2.
Figure 5:
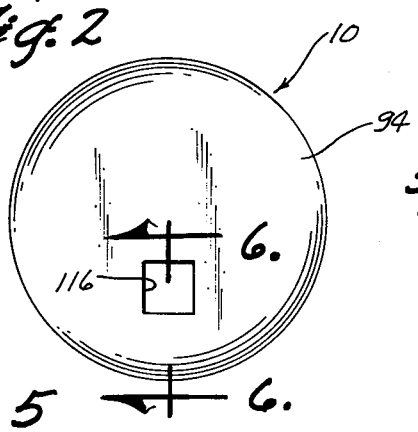
FIG. 5 is a plan view of the forward portion of the housing as seen on lines 5 — 5 of FIG. 4.
Figure 4:
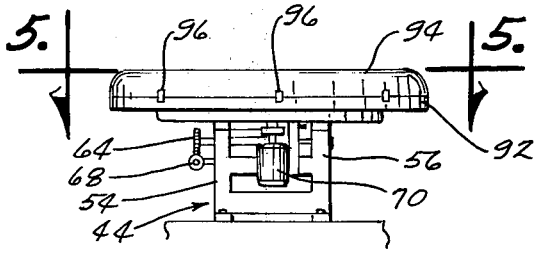
FIG. 4 is a rear view similar to FIG. 2 except that the mold has been pivoted to a horizontal position.

The casting machine of this invention is referred to generally by the reference numeral 10. The numeral 12 refers to the apparatus for supplying molten casting material to the interior of the casting machine. Apparatus 12 generally comprises a base 14 having a vertically disposed frame means 16 extending upwardly therefrom. A casting material hopper 18 is selectively vertically mounted on the frame means 16 by means of the assembly 20. More specifically, hopper 18 is mounted on a slide 22 having a translation screw 24 operatively connected thereto. Shaft 26 is rotatably mounted on the upper end of frame means 16 and has a gear 28 in mesh with the screw 24 so that rotation of shaft 26 causes the rotation of screw 24 which in turn causes the slide 22 to be vertically moved relative to the frame means 16. Shaft 26 is provided with a sprocket 30 on one end thereof which has the chain 32 extending therearound. Chain 32 also extends around a gear 34 connected to shaft 36 which has the wheel 38 mounted thereon. Thus, rotation of the wheel 38 causes hopper 18 to be vertically moved relative to the frame means 16. A discharge tube 40 extends downwardly from the lower end of the hopper 18 and includes a laterally and downwardly extending portion 42. Portion 42 directs the casting material in the direction of rotation. Base portion 14 is adapted to be secured to the support means 44 of the casting machine 10 as will be described in more detail hereinafter.

As previously stated, casting machine 10 includes a support means or base 44 which is preferably bolted to the supporting surface. The numeral 46 refers to a frame means having a pair of gear segments 48 and 50 secured thereto by any convenient means. Gear segments 48 and 50 are pivotally or rotatably secured to the support means 44 by means of the shaft 52 extending through the sides 54 and 56 of support means 44 and the gear segments 48 and 50.

Shaft 58 is rotatably mounted in and extends between the sides 54 and 56 as illustrated in FIG. 1 and has a pair of gears 60 and 62 mounted thereon which engage the teeth of the gear segments 48 and 50 respectively. One end of the shaft 58 is provided with a gear 64 thereon which is in mesh with the threads 66 of a shaft 68 rotatably mounted on the side 54. Thus, rotation of the shaft 68 causes shaft 58 to be rotated which causes the gear segments 48, 50 and the frame means 46 to be pivoted about shaft 52.

An electric motor 70 is suitably pivotally mounted on the frame means 46 and has a drive shaft 72 extending therefrom having a variable speed pulley 74 mounted thereon. Belt 76 extends around the pulley 74 and the pulley 78 which is mounted on shaft 80. Shaft 80 rotatably extends forwardly through the frame means 46 and has pulley 82 mounted on the forward end thereof. Belt 84 extends around pulley 82 and around a larger pulley 86 which is secured to the drive shaft 88 which is rotatably mounted in the frame means 46 and which extends rearwardly and forwardly therefrom. The numeral 90 refers generally to a housing comprising a back housing member 92 which is rigidly secured to the frame means 46 and a cover or front housing member 94 which may be detachably mounted on the housing member 92 by means of the connectors 96.

Figure 6:
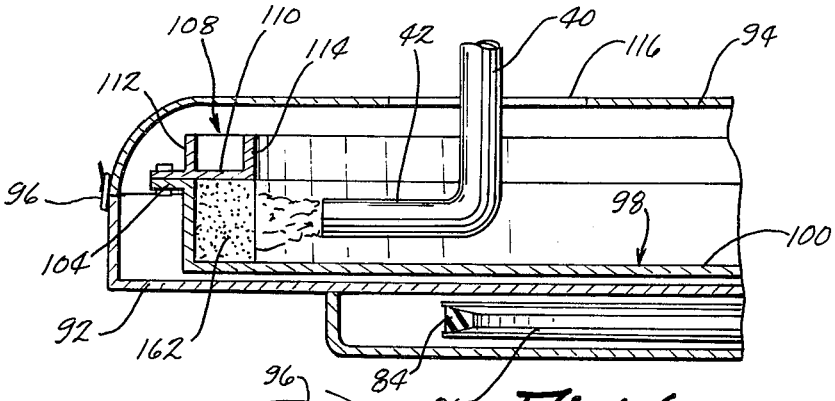
FIG. 6 is an enlarged sectional view as seen on lines 6 — 6 of FIG. 5.
Figure 7:
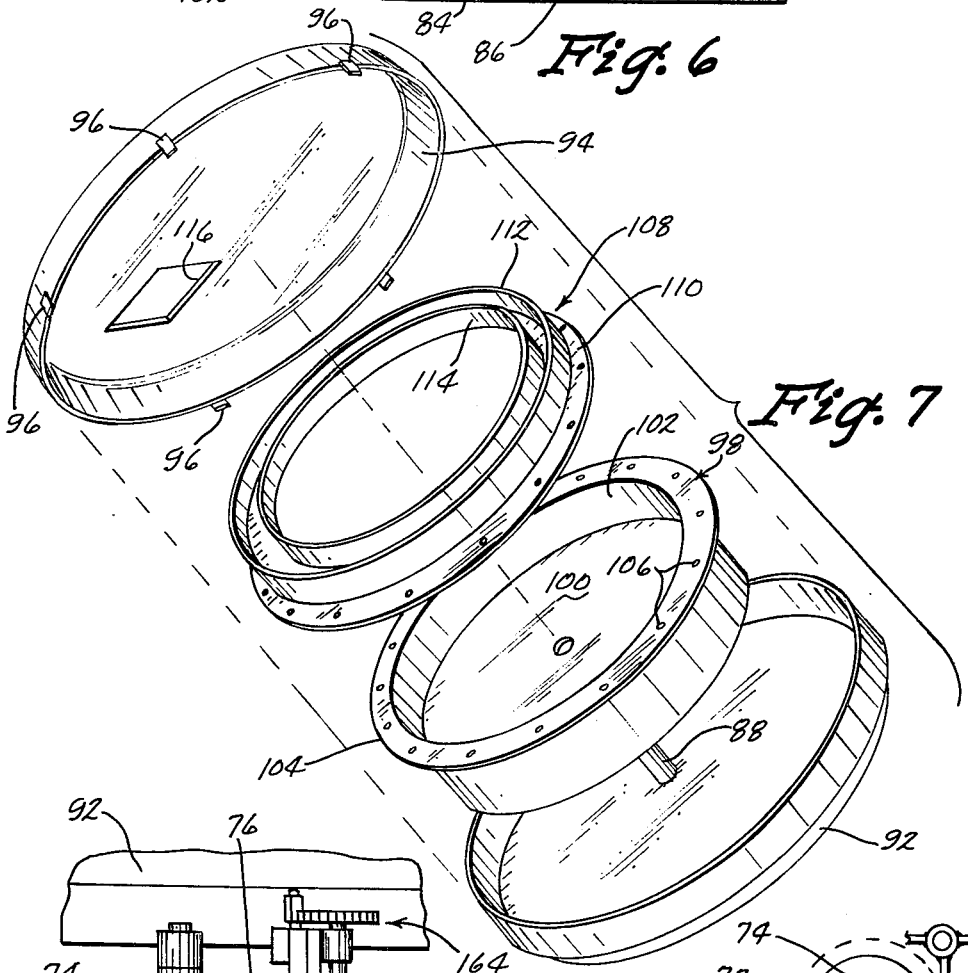
FIG. 7 is an exploded perspective view of the housing and mold.

Shaft 88 rotatably extends through back housing member 92 and has a base plate 98 rigidly secured thereto for rotation therewith. Base plate 98 forms a portion of the mold and generally comprises a central plate portion 100 having a peripheral wall 102 extending forwardly therefrom. A flange 104 is provided on the forward end of the peripheral wall 102 and is provided with a plurality of bolt openings 106 formed therein. The numeral 108 refers to a mold member comprising generally a ring shaped plate 110 which is bolted to the flange 104 and which has its inner periphery positioned inwardly of the wall 102 as illustrated in FIG. 6. A pair of reinforcing rings 112 and 114 are secured to the plate 110 and extend outwardly therefrom as also illustrated in FIGS. 6 and 7. It should be noted that the elements 98 and 108 form the mold and that the mold can assume any desired configuration depending upon the design of the desired finished product. As previously stated, cover 94 is detachably mounted on the housing member 92 by the connectors 96 to close the mold. Cover 96 is provided with a closable opening 116 in its lower forward portion which is adapted to receive the discharge tube 40 extending from the casting material hopper 18 as illustrated in FIG. 6. Straps or arms 118 and 120 may be detachably secured to the support means 44 to rigidly maintain the apparatus 12 in position during the actual casting operation.

Shaft 88 is provided with a longitudinally extending bore 120 extending therethrough. As seen in the drawings, the forward end of the shaft 88 is positioned forwardly of the plate portion 100. The numeral 122 refers to a deflector plate which is mounted on the forward end of shaft 88 by means of bolt 124 extending therethrough and being received by the threaded forward end of the bore 120. Bolt 124 is provided with a bore 126 which is in communication with bore 120. Bolt 124 is provided with a plurality of radially extending bores or passageways 88 which are in communication with the bore 126. Deflector plate 122 generally comprises a plate portion 130 having an opening 132 is the center portion thereof which receives the bolt 124 extending therethrough. Plate portion 130 includes a centrally disposed circular recess area 134 and a rearwardly extending peripheral wall surface 136 which is disposed at approximately a 20° angle. A plurality of radially extending grooves 138 extend outwardly from the area 134 to the periphery of the rearward portion of the plate 130.

An adaptor or plug 140 is threadably mounted in the rearward end of the shaft 88 so that the bore 142 therein communicates with the rearward end of the bore 120. The numeral 144 refers to a sleeve which is mounted on the rotating plug 140 and which has a passageway portion 146 formed therein. A pair of O-rings 148 and 150 are positioned in the sleeve 144 and embrace the plug 140 so as to seal the passageway portion 146 from the atmosphere. Bore 152 extends through the sleeve and communicates with the passageway 146 as illustrated in the drawings. The numeral 154 refers to a conduit or the like which is in communication with a source of gas such as Argon or the like. Plug 140 is provided with a plurality of radially extending passageways or bores 156 which extend radially outwardly from the bore 142 so as to communicate with the passageway 146. A pair of collars 158 and 160 are positioned on the opposite sides of the sleeve 144 and are secured to the plug 144 rotation therewith by means of set screws or the like.

Figure 8:
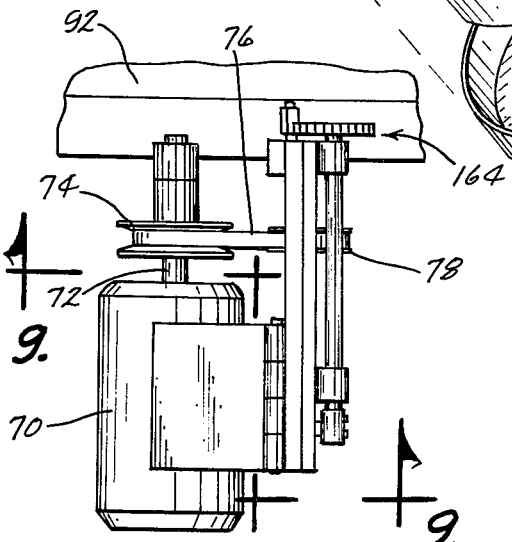
FIG. 8 is a top view of the variable speed drive of the apparatus.
Figure 9:
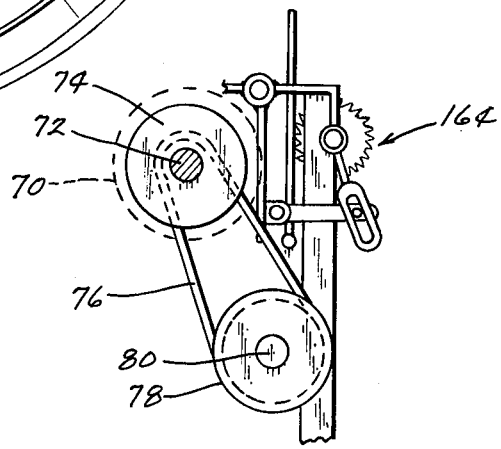
FIG. 9 is a sectional view seen on lines 9 — 9 of FIG. 8.
Figure 10:
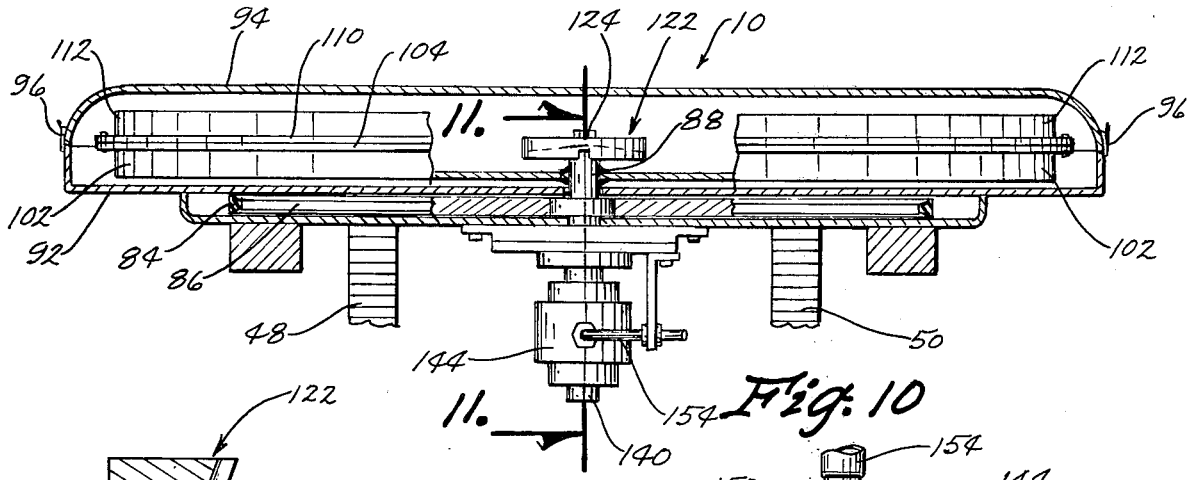
FIG. 10 is a sectional view as seen on lines 10 — 10 of FIG. 2.
Figure 11:
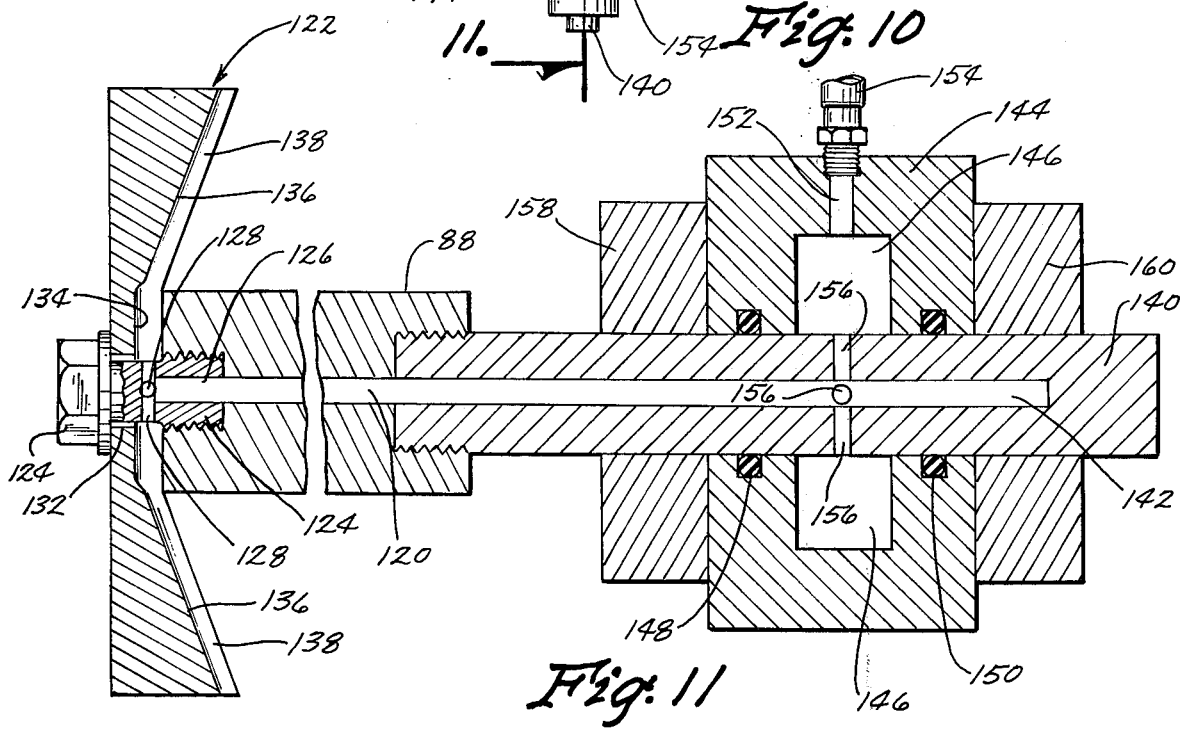
FIG. 11 is a sectional view as seen on lines 11 — 11 of FIG. 10.
Figure 12:
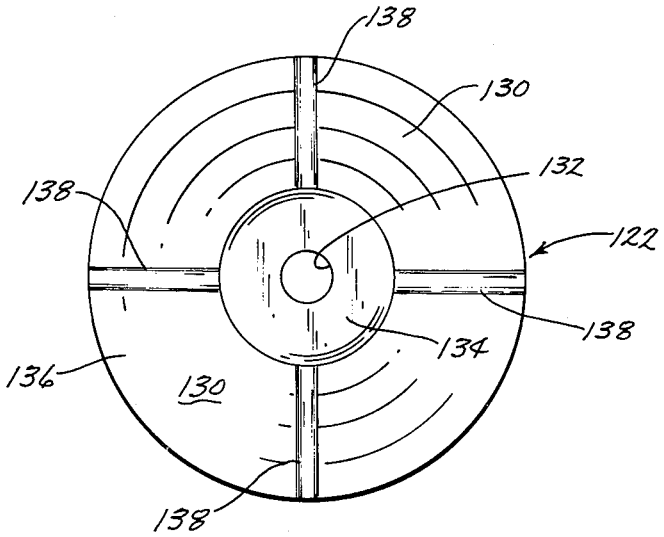
FIG. 12 is a rear view of the gas deflector plate.

The normal method of operation is as follows. Assuming that the mold 108 has been removed from the member 98 and that the housing open, the first step is to secure the mold 108 to the member 98. Cover 94 is then secured to the housing member 92 by the connectors 96. The shaft 68 is rotated to cause the housing and the mold to be pivoted to the desired position such as illustrated in FIG. 1. Apparatus 12 is then moved into position adjacent the casting machine so that the tube 42 extends inwardly through the opening 116 as illustrated in FIG. 6. The arms 118 and 120 are bolted to the support means 44 to insure that the apparatus 12 will be positively maintained in position during the casting operation. The molten casting material is then placed in the hopper 18 and the motor 70 energized to cause the member 98 and 108 to be rotated relative to the housing and to the discharge tube 42. If aluminum is to be cast into a ring member 162, the preferred rate of rotation of the mold is approximately 500 rmp. The rate of rotation of the mold may be easily changed by simply pivoting the motor 70 by means of the crank apparatus 164 connected thereto as illustrated in FIGS. 8 and 9 so that the belt 76 causes the variable speed pulley 74 to open or close in customary fashion. The molten material is then released from the hopper 18 so that the same is supplied to the interior of the rotating mold as illustrated in FIG. 6. The molten material moves to the periphery of the wall 102 through centrifugal force and through gravity so that a high-density end product is achieved.

If aluminum is the casting material being employed, it is recommended that argon gas be supplied to the interior of the mold so as to reduce the oxidation of the molten material during the casting and cooling thereof. The argon gas is fed through the conduit 154, passageway 152, passageway 146, bores 156, passageway 142, bore 120, bore 126 and bore 128. The argon gas is received by the recessed portion 134 and moves outwardly towards the rearward periphery of the deflector plate through the grooves 138. The rearwardly extending portion 136 causes the gas to be deflected rearwardly and outwardly towards the plate portion 100 so that the gas is fed outwardly towards the material being cast. The presence of the argon gas substantially reduces the oxidation of the aluminum casting material and also aids in the cooling of the material. If desired, other types of gas may be supplied to the interior of the mold depending upon the particular product being cast. Additionally, cold air could be supplied to the interior of the mold as previously described so as to aid in cooling the molten casting material.

After the cast has sufficiently cooled, motor 74 is stopped. The apparatus 12 is moved outwardly away from the casting machine 10 for convenience and the cover 94 is then removed from the housing member 92. The member 108 is then removed from the mold 102 to facilitate the cast 162 being removed from the mold. The apparatus is then ready for the subsequent casting operation.

The fact that the mold may be tilted permits the casting material to be supplied to the lower forward portion of the mold which prevents the casting material from objectionably "roiling" or being agitated as the material is being fed to the interior of the mold. The tilting of the mold also eliminates the need for supplying the casting material to the interior of the mold from a position over the mold as in the case in the conventional centrifugal casting machines which have a mold rotatably mounted about a vertical axis. The mold may be tilted in response to the particular type of material being cast and the particular type of end product which is being obtained. The degree of tilting of the mold will depend upon those factors and results in a superior product being achieved.

Thus it can be seen that the casting machine of this invention accomplishes at least all of its stated objectives.

We claim:

1. A centrifugal casting machine, comprising,
a support means,
a mold means rotatably mounted on said support means,
power means for rotating said mold means,
means operatively pivotally connecting said mold means to said support means about a horizontal axis, whereby the rotational attitude of said mold means may be selectively varied relative to said support means,
a non-rotatable housing means pivotally secured to said support means,
said mold means comprising a rotatable mold member rotatably mounted within said housing means,
a drive shaft secured to said mold member and extending through said housing means,
said power means being connected to said drive shaft for rotating said mold member relative to said housing means, said drive shaft having a passageway means formed therein extending therethrough for supplying a gaseous material to the interior of said mold member,
said drive shaft having first and second ends, said first end being centrally disposed within said mold member, said second end being disposed outwardly of said housing means,
and a gas deflector plate mounted on said first end of said drive shaft.

2. The casting machine of claim 1 wherein said deflector plate is disc-shaped and has front and back sides, said deflector plate having a beveled peripheral portion on its back side for deflecting the gas outwardly and rearwardly from said drive shaft towards said mold member.

3. A centrifugal casting machine, comprising,
a support means,
a non-rotatable housing mounted on said support means comprising a back housing member having an open forward end and a front cover element detachably secured to said back housing member for selectively closing said open forward end,
a mold means rotatably mounted on said support means and being positioned within said housing,
power means for rotating said mold means,
means operatively pivotally connecting said housing and said mold means to said support means about a horizontal axis whereby the rotational attitude of said mold means may be selectively moved relative to said support means,
said open forward end of said back housing member being larger than the diameter of said mold means to permit the removal of said mold means from said housing means,
a drive shaft secured to said mold means and extending through said housing means,
said power means being connected to said drive shaft for rotating said mold member relative to said housing means,
said drive shaft having a passageway means formed therein extending therethrough for supplying a gaseous material to the interior of said mold member,
and means for dispersing the gaseous material within said mold means.

4. A centrifugal casting machine, comprising,
a support means,
a non-rotatable housing mounted on said support means comprising a back housing member having an open forward end and a front cover element detachably secured to said back housing member for selectively closing said open forward end,
a mold means rotatably mounted on said support means and being positioned within said housing,
power means for rotating said mold means,
means operatively pivotally connecting said housing and said mold means to said support means about a horizontal axis whereby the rotational attitude of said mold means may be selectively moved relative to said support means,
said open forward end of said back housing member being larger than the diameter of said mold means to permit the removal of said mold means from said housing means,
said cover element having an opening formed therein which is in communication with said mold means, and a casting material receptacle positioned adjacent said housing and operatively removably secured to said support means for supplying molten casting material through said cover element opening into said mold means,
said casting material receptacle comprising a hopper means having a discharge tube extending downwardly outwardly and laterally therefrom.

5. A centrifugal casting machine, comprising,
a support means,
a non-rotatable housing mounted on said support means comprising a back housing member having an open forward end and a front cover element detachably secured to said back housing member for selectively closing said open forward end,
a mold means rotatably mounted on said support means and being positioned within said housing,
power means for rotating said mold means,
means operatively pivotally connecting said housing and said mold means to said support means about a horizontal axis whereby the rotational attitude of said mold means may be selectively moved relative to said support means,
said open forward end of said back housing member being larger than the diameter of said mold means to permit the removal of said mold means from said housing means,
said means pivotally connecting said housing means to said support means comprising a gear segment means selectively pivotally secured, about a horizontal axis, to said support means, said housing means being secured to said gear segment means for pivotal movement therewith, and a selectively rotatable gear means on said support means in mesh with said gear segment means whereby rotation of said gear means causes said gear segment means and said housing means to be pivotally moved relative to said support means.

* * * * *